US005501490A

United States Patent [19]

Lo

[11] Patent Number: 5,501,490

[45] Date of Patent: Mar. 26, 1996

[54] ALBUM

[76] Inventor: Yung-Hung Lo, 3F, No. 11, Lane 14, Chung San St., Hsi Chih Town, Taipei Hsien, Taiwan

[21] Appl. No.: 476,352

[22] Filed: Jun. 7, 1995

[51] Int. Cl.[6] ..... B42D 1/00

[52] U.S. Cl. ..... 281/21.1; 281/29; 281/37; 402/70; 402/73

[58] Field of Search ..... 281/21.1, 29, 37; 402/70, 73

[56] References Cited

U.S. PATENT DOCUMENTS 4,170,423 10/1979 Bourbon ..... 402/70
5,190,127 3/1993 Cummings ..... 402/70 X

FOREIGN PATENT DOCUMENTS 2448999 4/1976 Germany ..... 402/70

*Primary Examiner*—Willmon Fridie, Jr.
*Attorney, Agent, or Firm*—Bacon & Thomas

[57] ABSTRACT

An album including a rectangular case consisting of a rectangular bottom shell and a rectangular cover shell pivoted to one side of the rectangular bottom shell, a stack of pocket-designed blank pages received inside the rectangular case for holding pictures, and a binding plate having a plurality of upright retainer rods spaced at one side and respectively inserted through respective binding holes in the middle of the stack of pocket-designed blank pages and then fitted into respective binding holes on an upright wall of the cover shell to hold down the stack of pocket-designed blank pages in place.

3 Claims, 5 Drawing Sheets

ALBUM

BACKGROUND OF THE INVENTION

The present invention relates to albums, and relates more particularly to such an album which comprises a rectangular case and a stack of pocket-designed blank pages detachably fastened to the inside of the case by a binding plate for holding pictures.

Regular albums (see FIG. 1) are commonly made in the form of a book comprised of a cover sheet 5, and a plurality of pocket-designed blank pages 7 fastened to the cover sheet 5 on the inside by clips 6A and 6B. As the cover sheet 5 is made of a paper board, it tends to decay quickly or be ruptured easily. Another drawback of this structure of album is that it is difficult to be maintained in the standing position (see FIG. 2). Still another drawback of this structure of album is that the pocket-designed blank pages 7 tend to be pulled away from the clips 6A and 6B. Still another drawback of this structure of album is that the spine of the cover sheet 5 has no space for marking marks for classification of pictures. Furthermore, this structure of album looks not valuable, and therefore it cannot be used as a precious gift.

SUMMARY OF THE INVENTION

The present invention has been accomplished to provide an album which eliminates the aforesaid drawbacks. It is one object of the present invention to provide an album which protects the pocket-designed blank pages for pictures against dust, moisture, vermin, etc. It is another object of the present invention to provide an album which has a label on the spine thereof for marking marks for classification of pictures. It is still another object of the present invention to provide an album which is simple in structure and has a valuable outer appearance.

According to one aspect of the present invention, there is provided an album comprised of a rectangular case consisting of a rectangular bottom shell and a rectangular cover shell pivoted to one side of the rectangular bottom shell, a stack of pocket-designed blank pages received inside the rectangular case for holding pictures, and a binding plate having a plurality of upright retainer rods spaced at one side and respectively inserted through respective binding holes in the middle of the stack of pocket-designed blank pages and then fitted into respective binding holes on an inner upright wall of the cover shell to hold down the stack of pocket-designed blank pages in place. According to another aspect of the present invention, the cover shell has an outer upright wall along one long side thereof pivotably connected between two upright side walls on two opposite short sides of the bottom shell, and a label on the outer upright wall for marking marks for classification of pictures.

DETAILED DESCRIPTION OF THE PREFERRED EMBODIMENT

Figure 1:
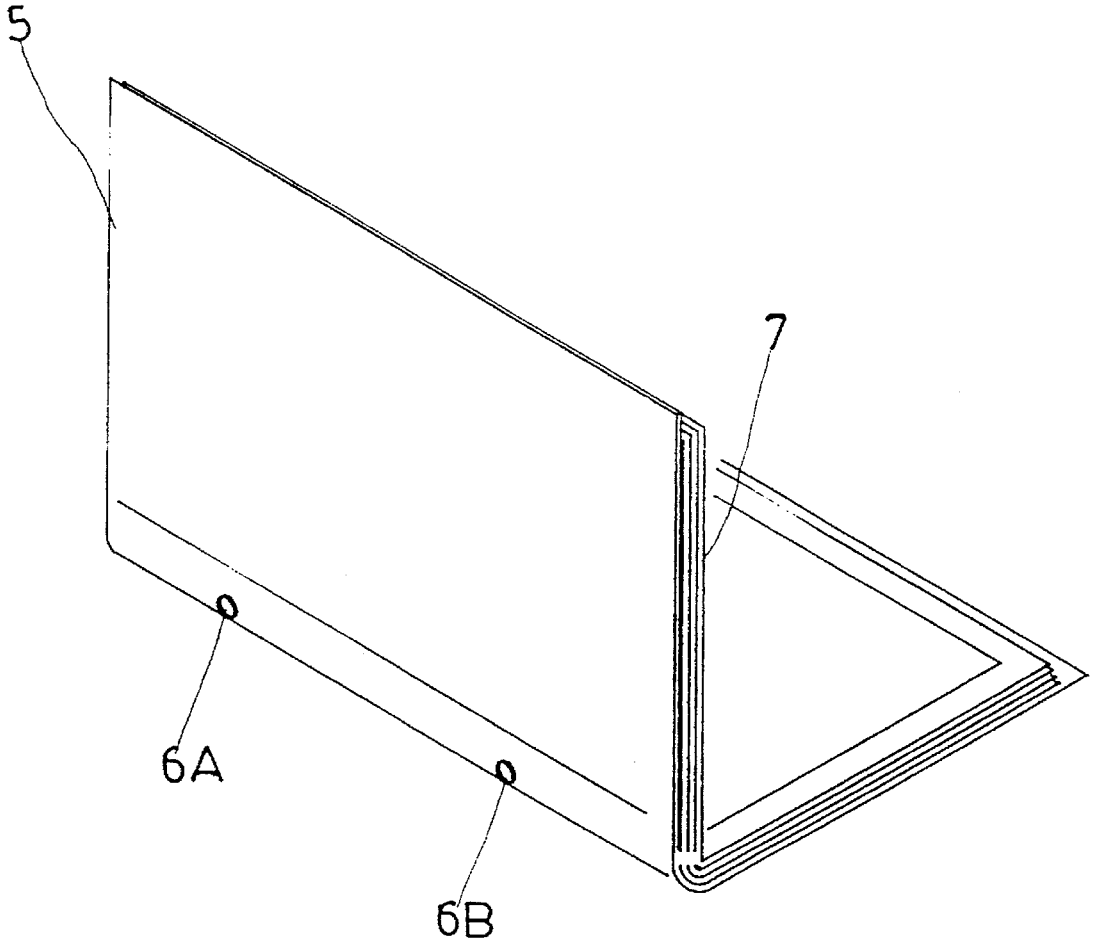
FIG. 1 (PRIOR ART)
FIG. 1 shows an album according to the prior art.
Figure 2:
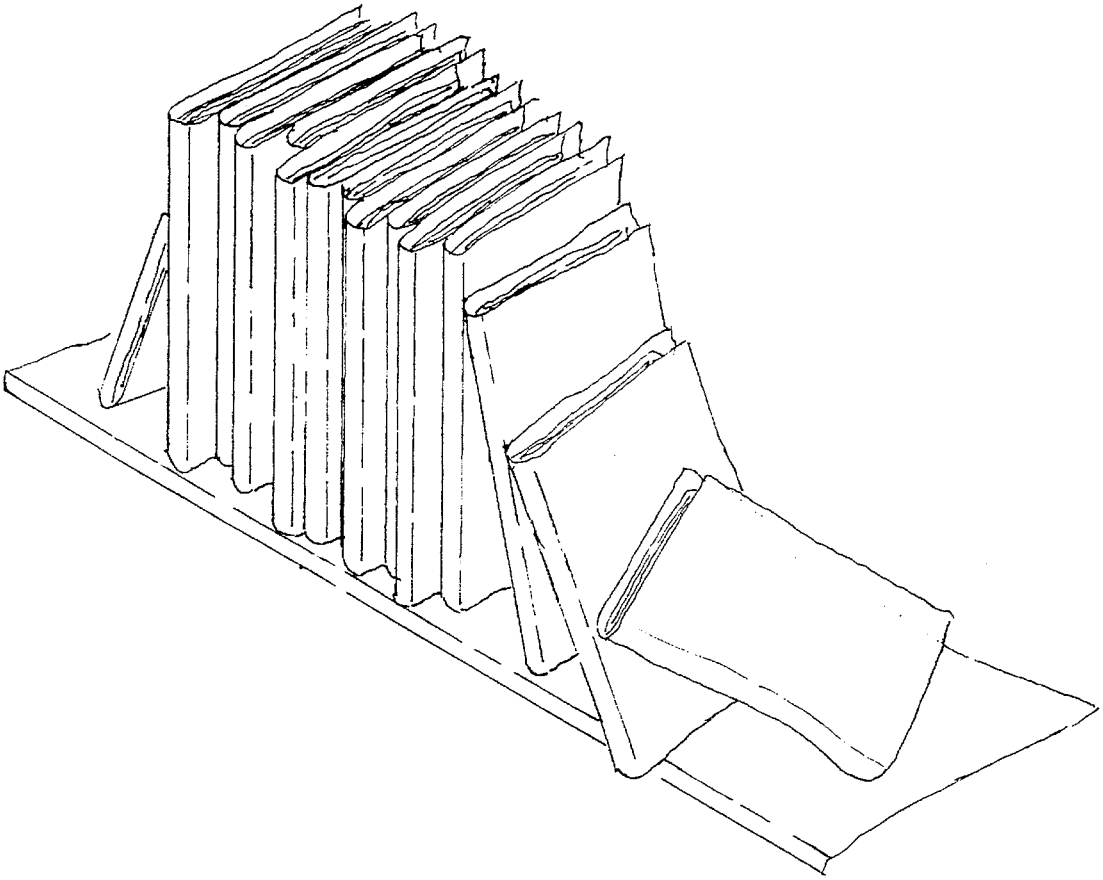
FIG.2 (PRIOR ART)
FIG. 2 shows a plurality of prior art albums arranged together.
Figure 3:
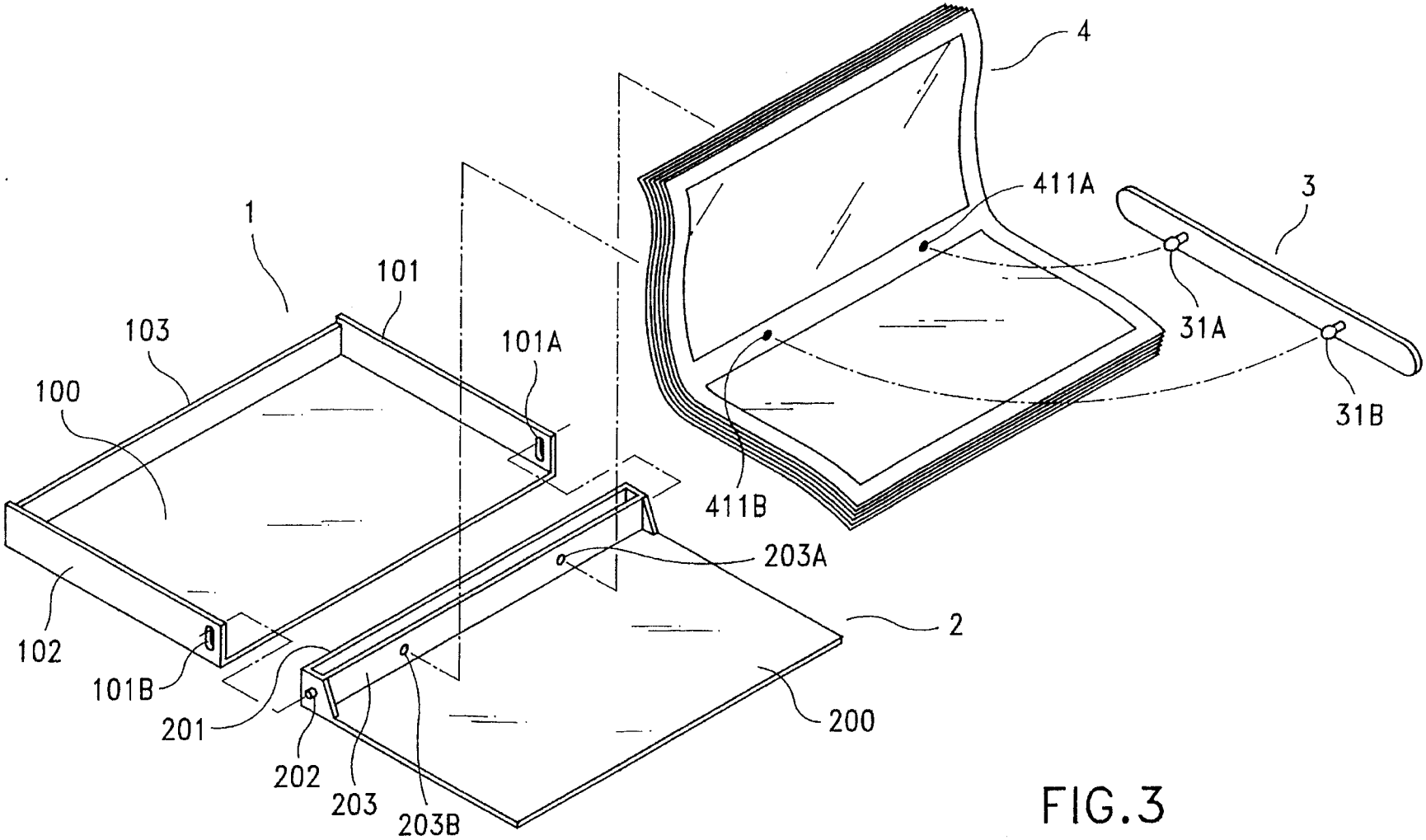
FIG. 3 is an exploded view of an album according to the present invention.

Referring to FIG. 3, an album in accordance with the present invention is generally comprised of a rigid bottom shell 1, a rigid cover shell 2, an elongated binding plate 3, and a stack of pocket-designed blank pages 4.

Figure 4:
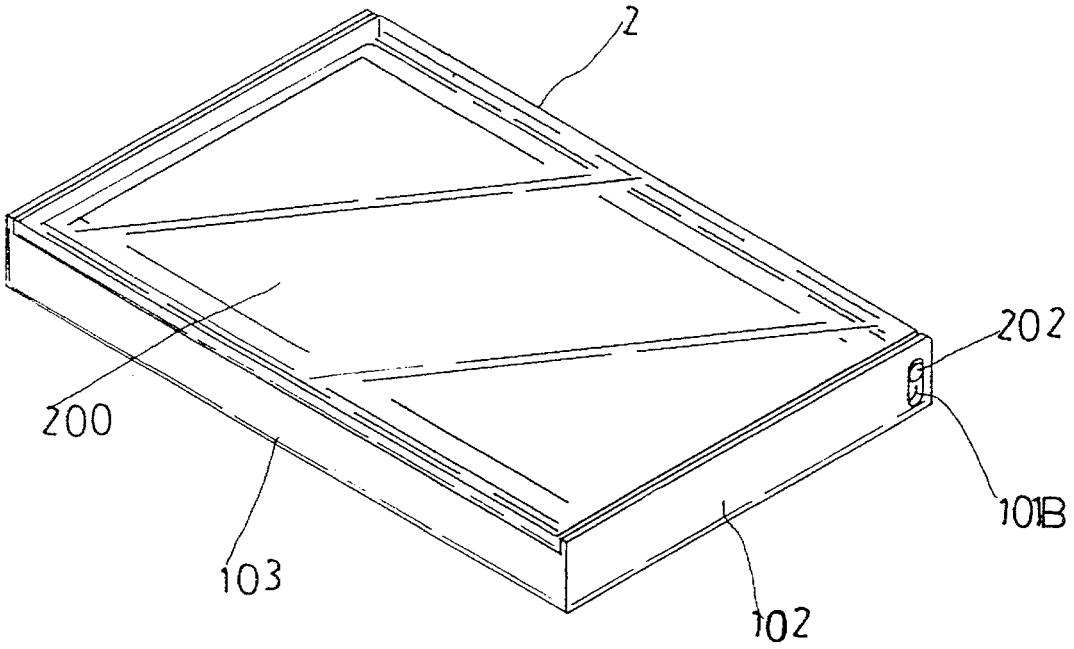
FIG. 4 is an elevational view of the album shown in FIG. 3.
Figure 5:
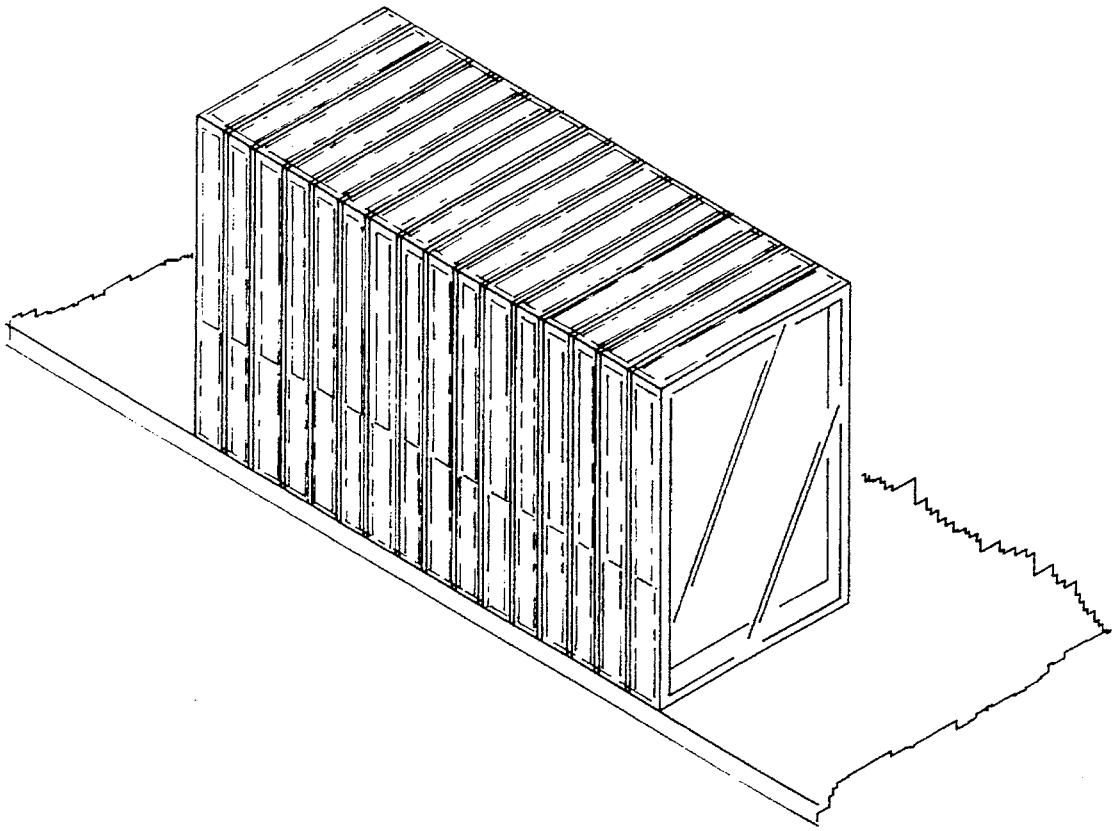
FIG. 5 shows a plurality of albums of the present invention arranged together in good order.

Referring to FIGS. 4 and 5 and FIG. 3 again, the bottom shell 1 is made of rectangular shape comprising a flat rectangular base 100, a first upright side wall 101 and a second upright side wall 102 respectively raised from two opposite short sides of the flat rectangular base 100, a third upright side wall 103 raised from one long side of the flat rectangular base 100 and connected between the first upright side wall 101 and the second upright side wall 102, a first oblong slot 101A on the first upright side wall 101 at one end remote from the third upright side wall 103, and a second oblong slot 101B on the second upright side wall 102 at one end remote from the third upright side wall 103. The cover shell 2 fits over the bottom shell 1, comprising a flat rectangular base 200, two parallel upright walls, namely, the outer upright wall 201 and the inner upright wall 203 raised along one long side of the rectangular base 200, two outward pivot pins 202 disposed at two opposite ends of the upright walls 201 and 203 and respectively inserted into the first oblong slot 101A and the second oblong slot 101B for permitting the cover shell 2 to be pivotably connected to the bottom shell 1, and a plurality of binding holes 203A and 203B longitudinally spaced on the inner upright wall 203 for mounting the binding plate 3. The outer upright wall 201 has a label (not shown) on the outside for marking marks for the classification of pictures. The binding plate 3 has a plurality of upright retainer rods 31A and 31B respectively inserted through respective binding holes 411A and 411B on the stack of pocket-designed blank pages 4 and fitted into the binding holes 203A and 203B on the inner upright wall 203 of the cover shell 2 to fix the stack of pocket-designed blank pages 4 to the cover shell 2 for holding pictures. When the cover shell 2 is closed on the bottom shell 1, the stack of pocket-designed blank pages 4 is folded up and protected inside the bottom shell 1. When several albums are used, they can be arranged together in good order and marked with respective marks for quick classification.

It is to be understood that the drawings are designed for purposes of illustration only, and are not intended as a definition of the limits and scope of the invention disclosed.

I claim:

1. An album comprising:

a bottom shell made of rectangular shape, said bottom shell comprising a flat rectangular base, a first upright side wall and a second upright side wall respectively raised from two opposite short sides of said flat rectangular base of said bottom shell, a third upright side wall raised from one long side of said flat rectangular base of said bottom shell and connected between said first upright side wall and said second upright side wall, a first slot on said first upright side wall at one end remote from said third upright side wall, and a second slot on said second upright side wall at one end remote from said third upright side wall;

a cover shell covered on said bottom shell, said cover shell comprising a flat rectangular base, an outer upright wall and an inner upright wall raised along one long side of said rectangular base of said cover shell, two outward pivot pins disposed at two opposite ends of said inner and outer upright walls and respectively inserted into said first slot and said second slot of said bottom shell for permitting said cover shell to be pivotably connected to said bottom shell, and a plurality of binding holes longitudinally spaced on said inner upright wall;

a stack of pocket-designed blank pages received inside said bottom shell and said cover shell for holding pictures, said stack of pocket-designed blank pages having a plurality of binding holes longitudinally aligned in the middle; and an elongated binding plate fastened to said inner upright wall of said cover shell to hold said stack of pocket-designed blank pages in place, said binding plate having a plurality of upright retainer rods spaced at one side and respectively inserted through said binding holes on said stack of pocket-designed blank pages and then fitted into the binding holes on said inner upright wall of said cover shell to hold down said stack of pocket-designed blank pages in place.

2. The album of claim 1 wherein said first slot and said second slot are respectively made of oblong shape.

3. The album of claim 1 wherein the number of the binding holes on said stack of pocket-designed blank pages and the number of the binding holes on said inner upright wall of said cover shell as well as the number of said retainer rods of said binding plate are two.

* * * * *